US011760098B2

(12) United States Patent
Saeki et al.

(10) Patent No.: US 11,760,098 B2
(45) Date of Patent: Sep. 19, 2023

(54) LIQUID DISCHARGE APPARATUS

(71) Applicant: CANON KABUSHIKI KAISHA, Tokyo (JP)

(72) Inventors: Tsuyoshi Saeki, Kanagawa (JP); Yuri Mori, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 30 days.

(21) Appl. No.: 17/669,025

(22) Filed: Feb. 10, 2022

(65) Prior Publication Data

US 2022/0258477 A1 Aug. 18, 2022

(30) Foreign Application Priority Data

Feb. 12, 2021 (JP) ..... 2021-020825

(51) Int. Cl.
*B41J 2/175* (2006.01)

(52) U.S. Cl.
CPC ..... *B41J 2/175* (2013.01); *B41J 2/1752* (2013.01); *B41J 2/17506* (2013.01); *B41J 2/17509* (2013.01); *B41J 2/17523* (2013.01)

(58) Field of Classification Search
CPC ..... B41J 2/1721; B41J 2/175; B41J 2/17506; B41J 2/17509; B41J 2/17523; B41J 19/005; B41J 25/304; B41J 29/02; B41J 29/13; B41J 29/38
See application file for complete search history.

(56) References Cited

U.S. PATENT DOCUMENTS

2007/0146418 A1* 6/2007 Kuriki ..... B41J 2/14201 347/37
2015/0174906 A1* 6/2015 Sakamoto ..... B41J 2/17523 347/85
2015/0258798 A1* 9/2015 Miyamoto ..... B41J 29/13 347/85
2018/0126759 A1* 5/2018 Moriyama ..... B41J 25/304

FOREIGN PATENT DOCUMENTS

JP 2020168831 A 10/2020

* cited by examiner

*Primary Examiner* — Anh T Vo
(74) *Attorney, Agent, or Firm* — Canon U.S.A., Inc. IP Division

(57) ABSTRACT

A liquid discharge apparatus includes a tube configured to connect a liquid discharge unit and a liquid container, a protective member configured to protect the tube, and a holder configured to hold the protective member. The holder holds the protective member by a first projection of the holder being inserted into a first opening in the protective member, such that a portion of the first projection protrudes from the first opening, and, in a state where the protective member is attached to the holder, a length of the portion of the first projection in a first direction in which a short side of the first opening extends is greater than that of the first opening in the first direction, and the length of the portion of the first projection in the first direction is less than that of the first opening, in the second direction crossing to the first direction.

12 Claims, 8 Drawing Sheets

VIEW FROM ARROW A

LIQUID DISCHARGE APPARATUS

BACKGROUND OF THE DISCLOSURE

Field of the Disclosure

The present disclosure relates to a liquid discharge apparatus that discharges a liquid.

Description of the Related Art

Conventionally, there has been known a liquid discharge apparatus that includes a flexible tube for connecting a recording head that discharges a liquid and a container that contains the liquid to be supplied to the recording head. There has also been known a liquid discharge apparatus that further includes a protective member along the tube for the purpose of protecting the tube. The protective member is provided at a place where a user can access for removing jammed recording media, for example, and thus is desirably structured so as not to easily come off.

Japanese Patent Application Laid-Open No. 2020-168831 discusses that a protective member is retained by a projection provided on a carriage with a recording head mounted thereon, and the projection is covered with a cover so that the protective member is unlikely to come off.

In the configuration of Japanese Patent Application Laid-Open No. 2020-168831, however, there is the need to separately provide the cover for covering the projection, which may lead to an increase in the size of the apparatus.

SUMMARY OF THE DISCLOSURE

The present disclosure provides a liquid discharge apparatus that is capable of suppressing a protective member for a tube from coming off.

According to an aspect of the present disclosure, a liquid discharge apparatus a liquid container configured to contain a liquid to be supplied to a liquid discharge unit configured to discharge the liquid, a tube configured to connect the liquid discharge unit and the liquid container, a holding unit configured to hold the liquid discharge unit, a protective member disposed along the tube and configured to protect the tube, and a holder provided with the holding unit and configured to hold the protective member, wherein the holder holds the protective member by a first projection of the holder being inserted into a first opening provided in the protective member, such that a portion of the first projection protrudes from the first opening, and, in a state where the protective member is attached to the holder, a length of the portion of the first projection in a first direction in which a short side of the first opening extends is greater than a length of the first opening in the first direction, and the length of the portion of the first projection in the first direction is less than a length of the first opening, in a second direction, the second direction crossing to the first direction.

Further features of the present disclosure will become apparent from the following description of exemplary embodiments with reference to the attached drawings.

DESCRIPTION OF THE EMBODIMENTS

Hereinafter, an exemplary embodiment of the present disclosure will be described with reference to the drawings. However, the following exemplary embodiment does not limit the present disclosure, and all of combinations of features described in relation to the exemplary embodiment are not necessarily essential to the solutions of the present disclosure. Relative arrangements, shapes, and the like of constituent elements described in relation to the exemplary embodiment are mere examples and are not intended to limit the scope of the present disclosure to those arrangements, shapes, and the like.

Figure 1:
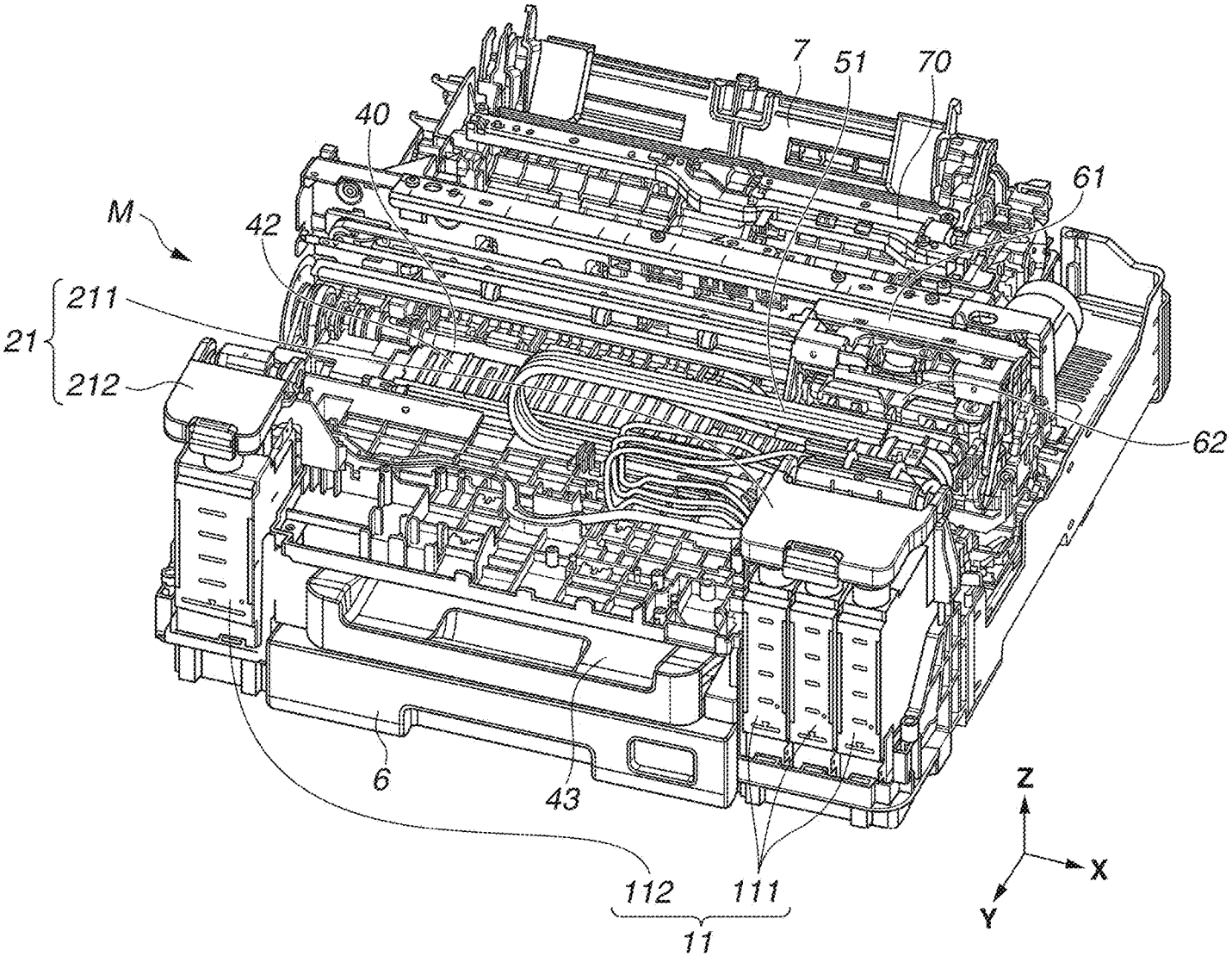
FIG. 1 is a perspective view of an internal configuration of a liquid discharge apparatus according to a present exemplary embodiment.

FIG. 1 is a perspective view of an internal configuration of a liquid discharge apparatus M in the present exemplary embodiment. The liquid discharge apparatus M of the present exemplary embodiment is an ink-jet recording apparatus that discharges ink as a liquid to perform recording on recording media, as an example. However, the present disclosure is also applicable to various liquid discharge apparatuses other than ink-jet recording apparatuses. In the drawings, arrows X and Y indicate horizontal directions orthogonal to each other, and an arrow Z indicates a vertical direction (a gravitational direction). The X direction is a right-left direction of the liquid discharge apparatus M, and the Y direction is a front-back direction of the liquid discharge apparatus M.

The "recording" includes not only forming significant information such as text and graphics but also forming significant or insignificant images, designs, and patterns, on recording media, or processing the media, regardless of whether the information is visualized such that humans can visually perceive it. In addition, the "recording media" are assumed as sheets of paper in the present exemplary embodiment, but can be cloth, plastic films, or the like.

The liquid discharge apparatus M includes liquid containers 11 that contain the liquid and a liquid discharge unit 62 that discharges the liquid supplied from the liquid containers 11 via a liquid supply path 51. In the present exemplary embodiment, the liquid containers 11 are provided on a front side of the liquid discharge apparatus M and fixed to an apparatus main body. The liquid containers 11 include first containers 111 that contain color ink including cyan ink, magenta ink, and yellow ink, and a second container 112 that contains black ink and is larger in capacity than the first containers 111. The kinds of ink are not limited to four kinds and the colors of ink are not limited to these colors.

The first containers 111 and the second container 112 are separated from each other in the X direction to sandwich a paper feed cassette 6 in which recording media can be stacked. However, the present disclosure is not limited to this configuration, and the first containers 111 and the second container 112 can be arranged side by side on one side of the X direction.

The liquid discharge apparatus M further includes a first tank cover 211 that integrally covers the tops of the plurality of (three in the present exemplary embodiment) first containers 111 and a second tank cover 212 that covers the top of the second container 112. Hereinafter, the first tank cover 211 and the second tank cover 212 is also collectively called tank covers 21.

The liquid discharge apparatus M feeds, by a paper feed roller 70 as a feed unit, a recording medium stacked on the paper feed cassette 6 on the front side or a paper feed tray 7 on a rear side. The recording medium fed by the paper feed roller 70 is conveyed by a conveyance roller 40 as a conveyance unit onto a platen 42 arranged at a position facing a liquid discharge surface of a liquid discharge unit 62. The platen 42 is a member for guiding and supporting the recording medium from the reverse face side of the recording medium on which the liquid discharge unit 62 performs recording.

The recording medium having undergone the recording by the liquid discharge unit 62 is ejected onto a paper ejection tray 43 by an ejection roller not illustrated. The paper ejection tray 43 is arranged above the paper feed cassette 6.

A direction in which the recording medium is conveyed by the conveyance roller 40 (Y direction) is also called a conveyance direction. An upstream side of the conveyance direction corresponds to the rear side of the liquid discharge apparatus M, and a downstream side of the conveyance direction corresponds to the front side of the liquid discharge apparatus M.

The liquid discharge unit 62 is mounted on a carriage 61 (holding unit) that reciprocates along a guide rail or the like in a main scanning direction (X direction) orthogonal to the conveyance direction. The liquid discharge unit 62 discharges liquid droplets while moving in the main scanning direction together with the carriage 61, thereby recording one band of an image on the recording medium (recording operation). When one band of an image is recorded, the recording medium is conveyed by a predetermined amount by the conveyance roller 40 in the conveyance direction (intermittent conveyance operation). Repeating the recording operation of the one band and the intermittent conveyance operation allows an image to be recorded on the entire recording medium based on recording data.

In the present exemplary embodiment, the liquid discharge unit 62 is a recording head capable of discharging cyan ink, magenta ink, yellow ink, and black ink. The recording head is detachably mounted on the carriage 61.

The liquid discharge apparatus M is provided with a recovery unit within a movement area of the carriage 61 and outside a recording area where the liquid discharge unit 62 performs the recording operation. The recovery unit performs a recovery operation for maintaining discharge performance of the liquid discharge unit 62, and is arranged at a position facing a discharge port surface 63 (see FIG. 2) where liquid discharge ports are arrayed.

Figure 2:
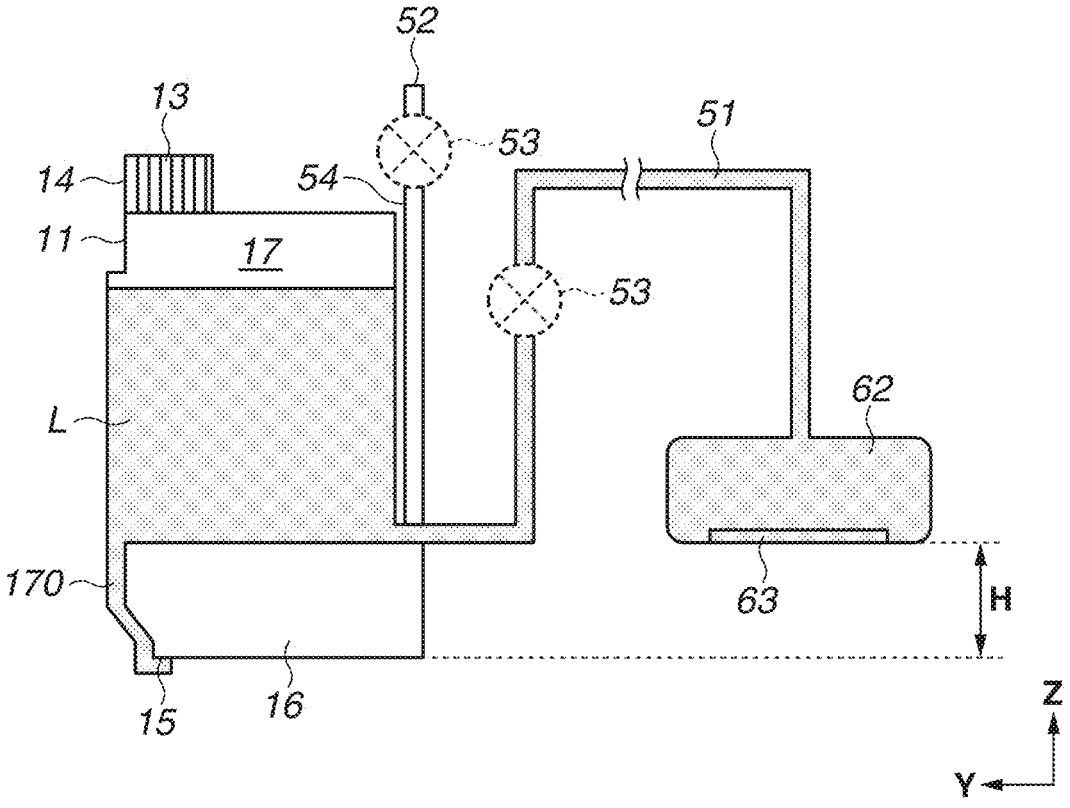
FIG. 2 is a schematic cross-sectional view of a liquid container and a liquid discharge unit according to the present exemplary embodiment, illustrating a positional relationship between these components.

FIG. 2 is a schematic cross-sectional view of the liquid container 11 and the liquid discharge unit 62, illustrating a positional relationship between these components. The liquid container 11 is provided with a tube 55, which is flexible, (see FIGS. 7A and 7B) constituting the liquid supply path 51 and attached to supply a liquid to the liquid discharge unit 62. Further, the liquid container 11 is provided with a flexible tube constituting an air communication path 54 to allow its inside to communicate with the air. The tube 55 constituting the liquid supply path 51 and the tube constituting the air communication path 54 are both formed of a material such as elastomer.

The liquid supply path 51 and the air communication path 54 are each provided with a valve unit 53 capable of blocking the communication between the liquid and the air. Each of the valve units 53 includes a black-side valve unit and a color-side valve unit. The color-side valve unit is capable of integrally blocking the liquid supply path 51 and the air communication path 54 connected to each of the three first containers 111.

The black-side valve unit is capable of blocking the liquid supply path 51 and the air communication path 54 connected to the second container 112.

Each of the liquid containers 11 is formed of a liquid chamber 17 containing the liquid and connected to the liquid supply path 51, a buffer chamber 16 provided below the liquid chamber 17 and connected to the air communication path 54, and an injection port 14 for injecting the liquid into the liquid chamber 17. The injection port 14 is blocked by a tank cap 13 except when the liquid is injected by the user.

Each of the liquid containers 11 has a gas-liquid exchange unit 15 where the liquid and the air are exchanged at a position (a height) H lower than the discharge port surface 63 as seen in a height direction. This applies a negative pressure on the discharge port surface 63 due to a head difference of the height H, so that the liquid can be suppressed from leaking out of the discharge ports.

The gas-liquid exchange unit 15 corresponds to a position of an opening facing the buffer chamber 16 of a communication path 170 forming a part of the liquid chamber 17. An area of the opening of the communication path 170 facing the buffer chamber 16 is sized to hold a meniscus of the liquid.

In the normal use state of the liquid discharge apparatus M, the buffer chamber 16 contains no liquid as illustrated in FIG. 2. In a case where the air in the liquid chamber 17 expands due to pressure variation or temperature change, the buffer chamber 16 can contain the liquid pressed out of the liquid chamber 17 via the communication path 170. This suppresses the liquid from leaking to the outside via the air communication path 54.

Figure 3C:
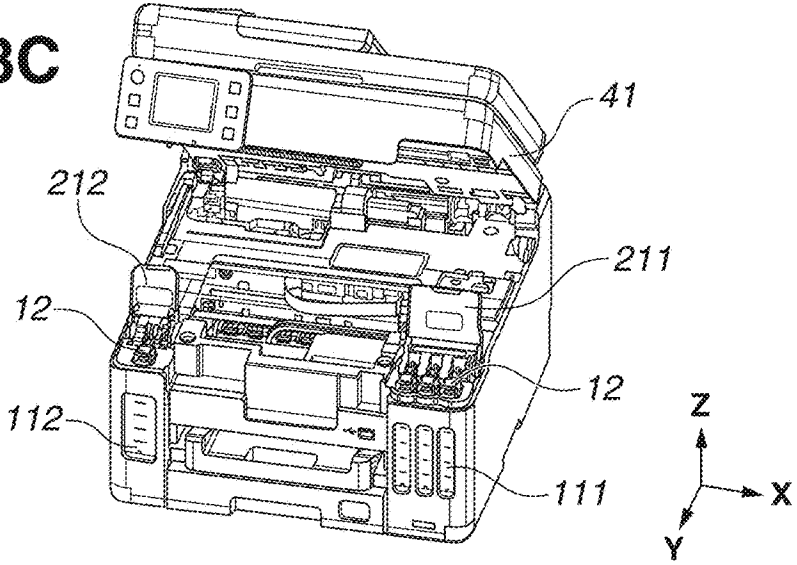
FIGS. 3A, 3B, 3C, and 3D are perspective views of external appearance of the liquid discharge apparatus according to the present exemplary embodiment.
Figure 3D:
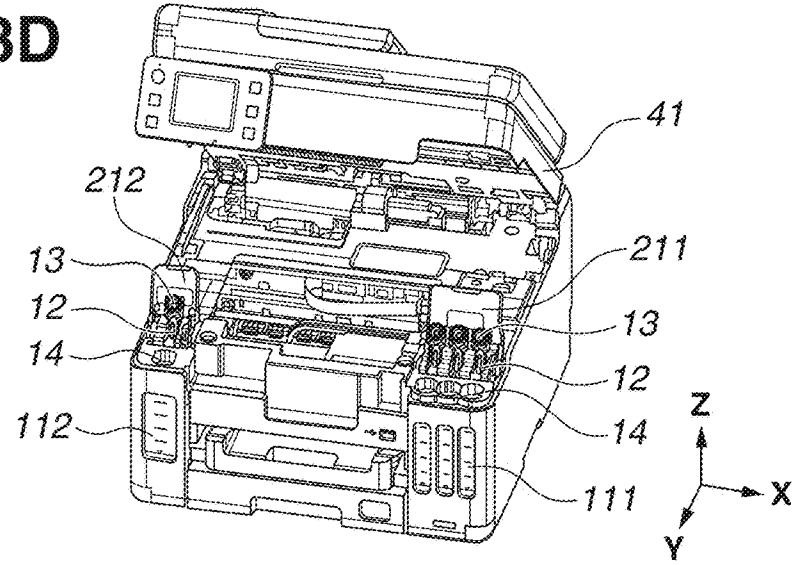
Figure 3A:
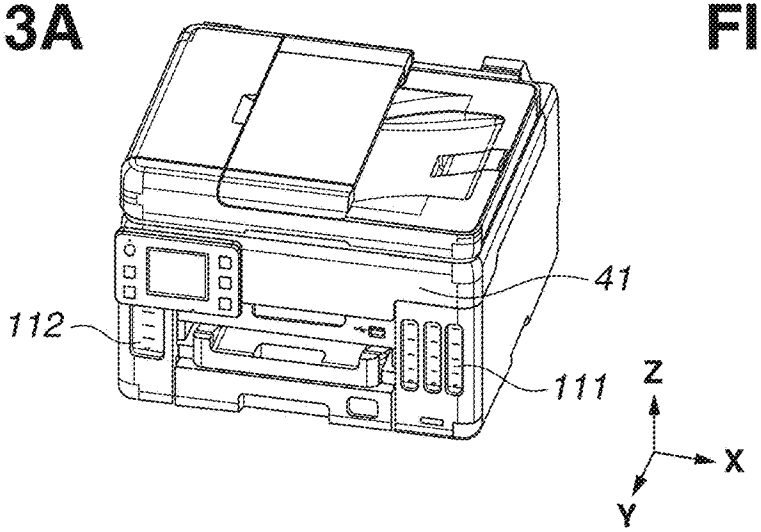

FIGS. 3A to 3D are perspective views of external appearance of the liquid discharge apparatus M, illustrating a procedure in which the user injects the liquid in the order of FIGS. 3A to 3D. As illustrated in FIG. 3A, the liquid discharge apparatus M has an access cover 41 pivotally supported in an openable and closable manner to cover the internal members such as the liquid discharge unit 62 and the liquid supply path 51. When the access cover 41 is opened, a part of the liquid supply path 51 formed of a tube is exposed. In the present exemplary embodiment, the access cover 41 includes a read unit capable of reading a placed document. However, the access cover 41 can be a simple cover member. FIG. 3A illustrates the access cover 41 in a closed state.

Figure 3B:
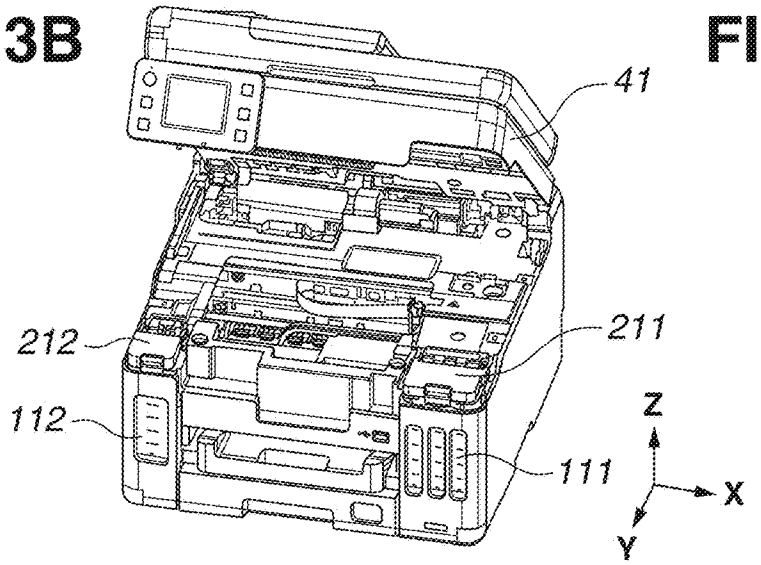

To inject the liquid into the liquid containers 11, the user turns upward to open the access cover 41 as illustrated in FIG. 3B. When the access cover 41 is turned by a predetermined amount, the access cover 41 can be held in an open state by a lock mechanism, which is not illustrated. To close the access cover 41, the user turns further upward the access cover 41 in the open state illustrated in FIG. 3B, so that the lock mechanism is unlocked to return the access cover 41 to the closed state as illustrated in FIG. 3A.

When the access cover 41 is opened, the tank covers 21 become exposed and accessible. Thus, the user turns the tank covers 21 upward to bring the tank covers 21 into the open state as illustrated in FIG. 3C. FIG. 3B illustrates the tank covers 21 in the closed state.

When the tank covers 21 are in the open state, cap levers 12 provided with the tank caps 13 for blocking the injection ports 14 in the liquid containers 11 become exposed. In the present exemplary embodiment, the cap levers 12 are pivotally supported in a turnable manner by the liquid discharge apparatus M or the corresponding liquid containers 11.

When the user turns upward the cap levers 12, the cap levers 12 move from blocked positions where the injection ports 14 are blocked by the tank caps 13 (see FIG. 3C) to open positions where the injection ports 14 are not blocked by the tank caps 13 (see FIG. 3D). When the cap levers 12 move to the open positions, the injection ports 14 are opened and exposed. Thus, the user injects the liquid from containers containing liquids, which are not illustrated, into the liquid containers 11 (the liquid chambers 17) via the injection ports 14.

Figure 4A:
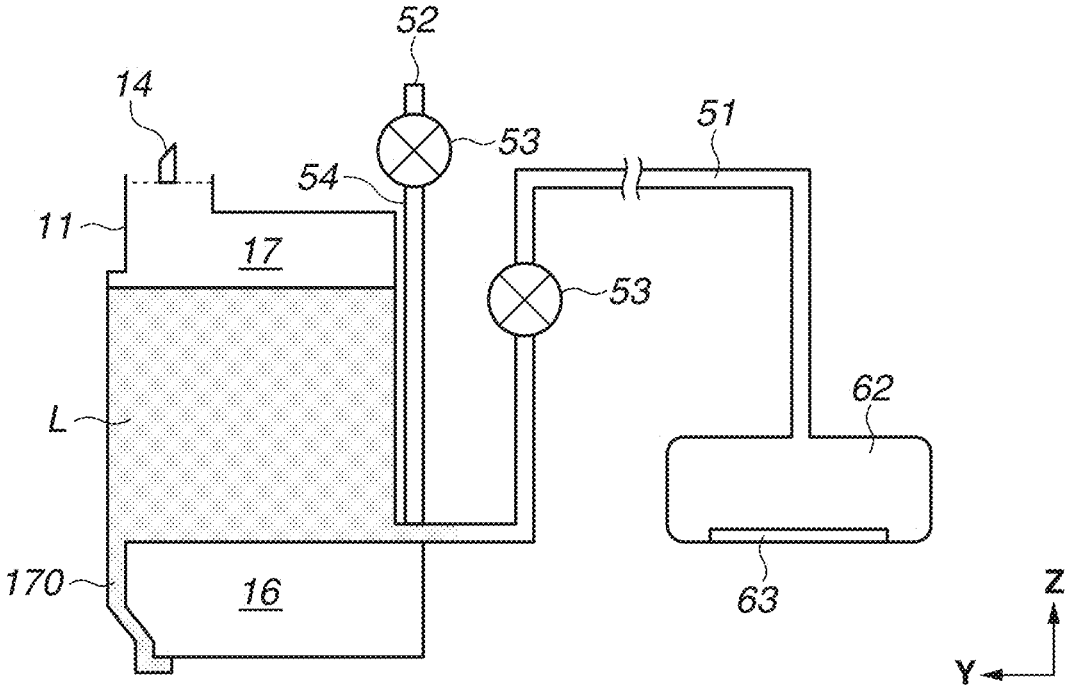
FIGS. 4A and 4B are schematic cross-sectional views of the liquid container and the liquid discharge unit according to the present exemplary embodiment, illustrating a positional relationship between these components.
Figure 4B:
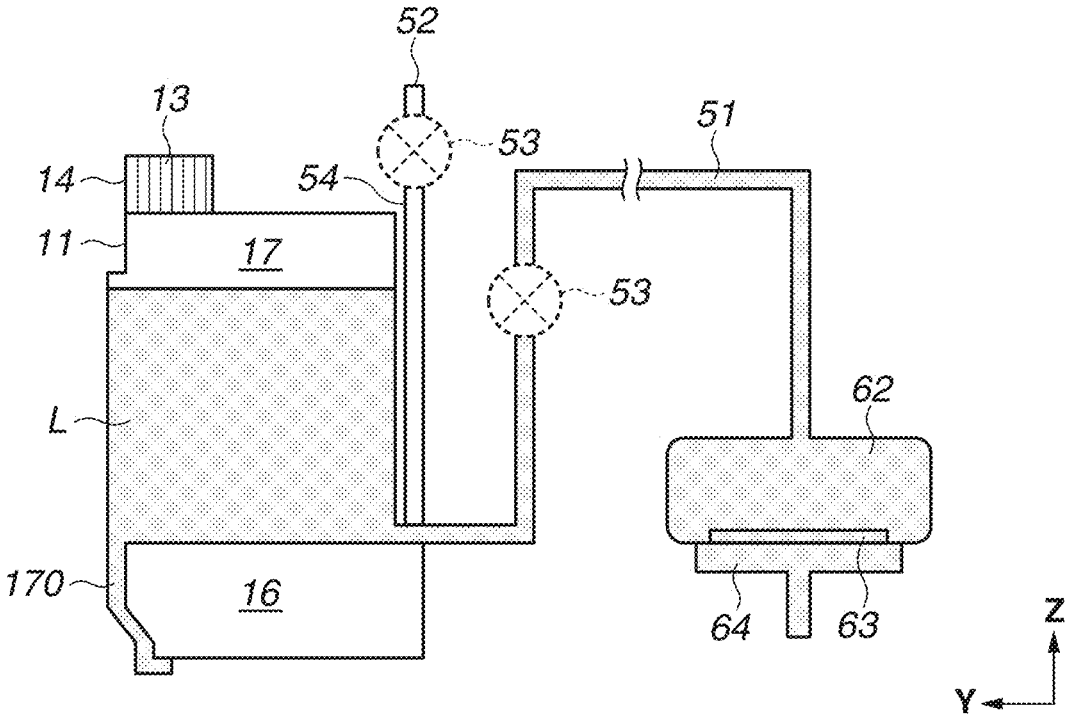

FIGS. 4A and 4B are schematic cross-sectional views of the liquid container 11 and the liquid discharge unit 62, illustrating a positional relationship between these components, where the liquid is supplied from the liquid container 11 to the liquid discharge unit 62. In particular, FIGS. 4A and 4B illustrate initial filling of the liquid by which the user supplies the liquid for the first time immediately after the installation of the liquid discharge apparatus M. FIGS. 4A and 4B are schematic diagrams in which some members such as the cap levers 12 are omitted.

FIG. 4A illustrates a state where the tank cap 13 is removed to expose the injection port 14 for injection of the liquid. In the state illustrated in FIG. 4A, the cap lever 12 is at the open position and the tank cover 21 is in the open state. In the present exemplary embodiment, in conjunction with the user's turning the tank cover 21 from the closed state to the open state, the valve units 53 block the liquid supply path 51 and the air communication path 54. That is, in the state illustrated in FIG. 4A, the liquid supply path 51 and the air communication path 54 are blocked by the valve units 53.

When the tank cap 13 is removed, a surface of a liquid L in the liquid chamber 17 communicates with the air via the injection port 14 that is exposed, so that the negative pressure due to the head difference is no longer applied to the discharge port in the liquid discharge unit 62. However, the liquid supply path 51 is blocked with the valve units 53 to regulate the movement of the liquid in the liquid supply path 51, thereby suppressing the liquid from leaking out of the discharge port.

After completion of injection of the liquid, the user moves the cap lever 12 to the blocked position to block the injection port 14 with the tank cap 13, and then turns the tank cover 21 from the open state to the closed state. In conjunction with the turning of the tank cover 21, the valve units 53 open the liquid supply path 51 and the air communication path 54. FIG. 4B illustrates a state where the liquid supply path 51 and the air communication path 54 are opened.

After that, when the user closes the access cover 41 to bring about the state illustrated in FIG. 3A, a detection unit, which is not illustrated, detects closing of the access cover 41. Then, to fill the liquid supply path 51 and the liquid discharge unit 62 with the liquid, the user brings a suction cap 64 constituting the recovery unit into abutment with the discharge port surface 63 so that a suction unit, which is not illustrated, performs a suction operation of sucking the air and the liquid L from the discharge port. By the suction operation, the liquid supply path 51 and the liquid discharge unit 62 are filled with the liquid in the liquid chamber 17 as illustrated in FIG. 4B.

In a filling completed state illustrated in FIG. 4B, when the liquid discharge unit 62 performs a recording operation, the liquid is discharged from the discharge port and is supplied from the liquid chamber 17 to the liquid discharge unit 62 by the same amount as that of the discharged liquid, and the air is introduced from the gas-liquid exchange unit 15 to the liquid chamber 17 by the same amount as that of the supplied liquid.

In the above description, the liquid containers 11 are fixed to the apparatus and the liquid is injected by the user as an example. However, the present disclosure is not limited to this but is applicable to the liquid containers 11 that are cartridges detachably attached to the apparatus.

Figure 5:
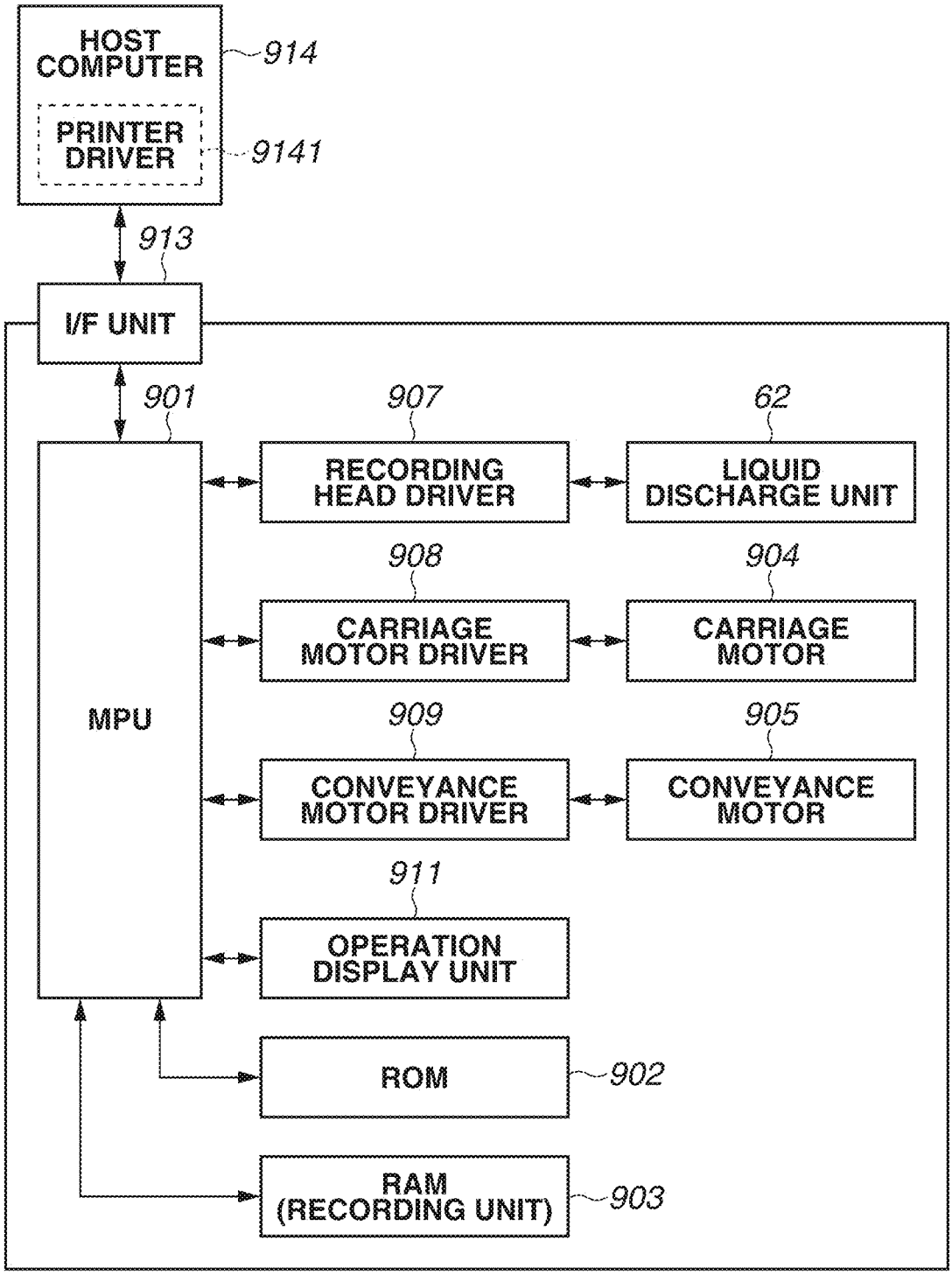
FIG. 5 is a block diagram of the liquid discharge apparatus according to the present exemplary embodiment.

FIG. 5 illustrates a block diagram of the liquid discharge apparatus M. A micro processing unit (MPU) 901 as a control unit controls operations of the components and data processing. A read only memory (ROM) 902 stores programs and data to be executed and processed by the MPU 901. A random access memory (RAM) 903 as a storage unit temporarily stores the data to be processed by the MPU 901 and the data received from a host computer 914.

The liquid discharge unit 62 is controlled by a recording head driver 907.

The carriage 61 is driven by a carriage motor 904. The carriage motor 904 is controlled by a carriage motor driver 908. The paper feed roller 70, the conveyance roller 40, and the ejection roller are driven by a conveyance motor 905. The conveyance motor 905 is controlled by a conveyance motor driver 909.

The host computer 914 includes a printer driver 9141 that, in a case where execution of a recording operation is ordered by the user, processes image(s) to be recorded and recording information such as image quality and communicates with the liquid discharge apparatus M. The MPU 901 exchanges the image(s) to be recorded with the host computer 914 via an interface (I/F) unit 913.

Figure 6:
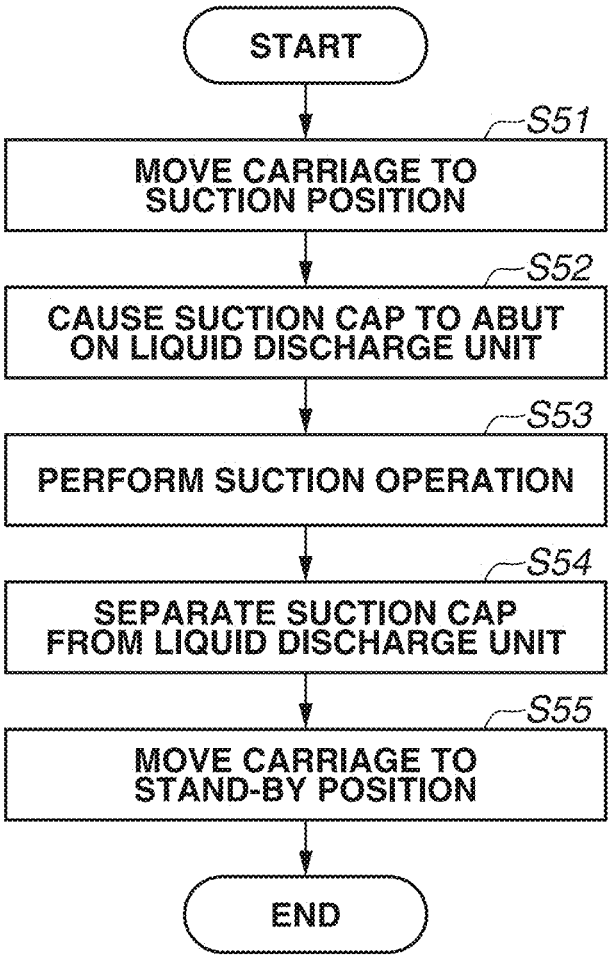
FIG. 6 is a flowchart describing a liquid filling sequence of the liquid discharge apparatus according to the present exemplary embodiment.

FIG. 6 is a flowchart of a liquid filling sequence for filling the liquid discharge unit 62 with the liquid. First, in step S51, the MPU 901 moves the carriage 61 provided with the liquid discharge unit 62 to a suction position that corresponds to a position where the discharge port surface 63 faces the suction cap 64.

In step S52, the MPU 901 moves upward the suction cap 64 to seal the discharge port surface 63. In step S53, the MPU 901 drives the suction unit connected to the suction cap 64 to perform a suction operation of sucking the liquid and the air from the discharge port of the liquid discharge unit 62. This suction operation allows the liquid supply path 51 and the liquid discharge unit 62 to be filled with the liquid.

After completion of the suction operation, in step S54, the MPU 901 moves downward the suction cap 64 to separate the suction cap 64 from the discharge port surface 63. Then, in step S55, the MPU 901 moves the carriage 61 from the suction position to a stand-by position, thereby completing the series of steps. In the present exemplary embodiment, the suction position and the stand-by position are the same, and the carriage 61 and the liquid discharge unit 62 are on stand-by in a state where the discharge port surface 63 is sealed with the suction cap 64.

Figure 7A:
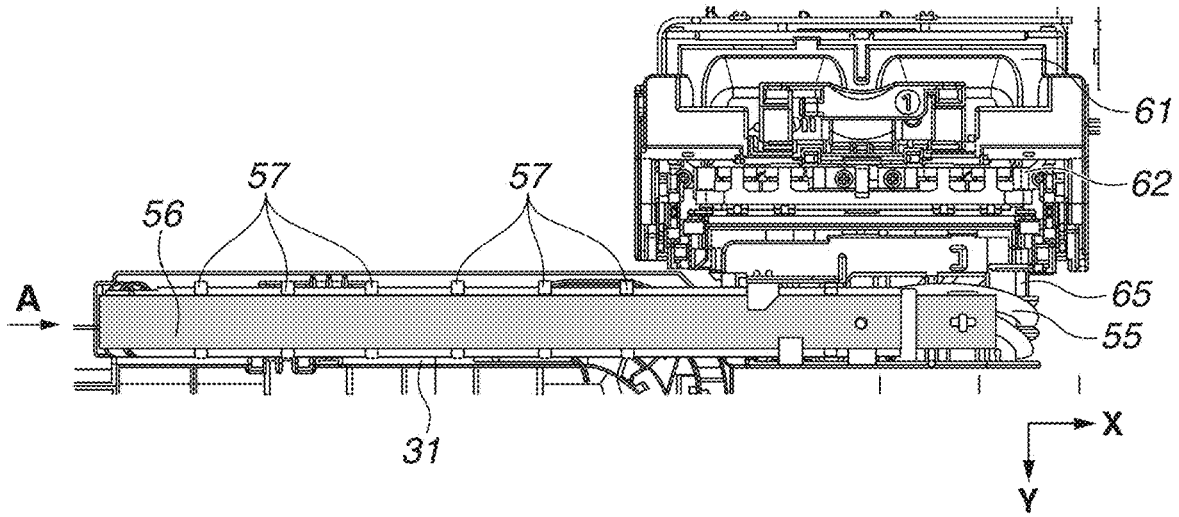
FIGS. 7A, 7B, and 7C are diagrams describing a detailed peripheral configuration of a liquid supply path according to the present exemplary embodiment.
Figure 7B:
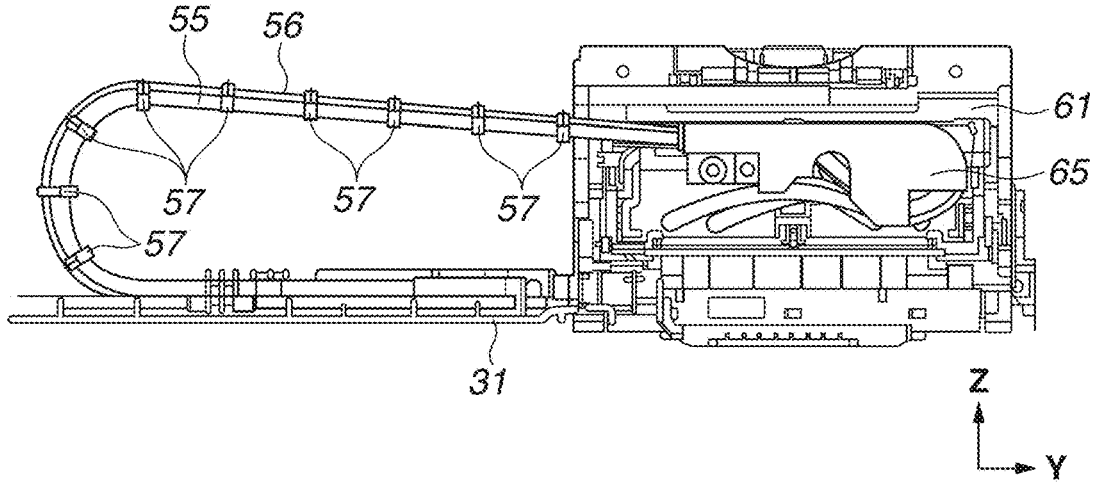
Figure 7C:
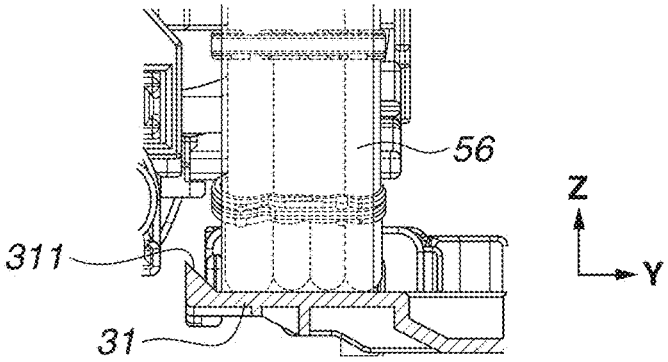

FIGS. 7A to 7C are diagrams describing in detail a peripheral configuration of the liquid supply path 51. FIG. 7A is a top view of the peripheral configuration, FIG. 7B is a front view of the peripheral configuration seen from the front side of the liquid discharge apparatus M, and FIG. 7C is a view of the peripheral configuration seen from a direction of an arrow A in FIG. 7A.

The tube 55 constitutes the liquid supply path 51, and connects the liquid containers 11 to the liquid discharge unit 62 as described above to form a flow path for supplying the liquid. As illustrated in FIG. 7B, the tube 55 is fixed to a plate 31 from a part of connection to the liquid containers 11, and is guided and supported in the X direction, and then is bent upward. The plate 31 is a fixing member that is arranged downstream of the carriage 61 as seen in the conveyance direction (Y direction) to fix the tube 55 to the liquid discharge apparatus M.

Further, the tube 55 is held by a holder 65 provided with the carriage 61 and connected to the liquid discharge unit 62. The tube 55 from the bent part not fixed by the plate 31 to the part held by the holder 65 can follow a reciprocating movement of the carriage 61.

A protective sheet 56 is a sheet member that serves as a protective member to reduce wear of the tube 55 by preventing the tube 55 from abutting with a lower surface of the access cover 41 when the tube 55 follows the reciprocating movement of the carriage 61. The protective sheet 56 is disposed along the tube 55. One end of the protective sheet 56 is fixed to the plate 31, and another end thereof is held by the holder 65. As with the tube 55, the protective sheet 56 needs to follow the reciprocating movement of the carriage 61 and thus, is desirably flexible. In the present exemplary embodiment, the protective sheet 56 is a plastic sheet.

In the present exemplary embodiment, the carriage 61 and the holder 65 are separate parts. However, the carriage 61 and the holder 65 can be formed as one part. That is, the other end of the protective sheet 56 can be held by the carriage 61.

The tube 55 is held (bundled) by clips 57 at a plurality of places. The clips 57 prevent abutment between the tube 55 and the protective sheet 56 to reduce wear of the tube 55. The plurality of clips 57 is arranged in the extended (a long-side) direction of the tube 55. The clips 57 are positioned such that, when the tube 55 follows the movement of the carriage 61, at least one of the clips 57 can prevent abutment with the lower surface of the access cover 41. Arranging the clips 57 in this manner makes it possible to reduce changes in the posture and speed of the carriage 61 due to repeated abutment and non-abutment of the clips 57 with the lower surface of the access cover 41.

As illustrated in FIG. 7C, the plate 31 has a slope 311 protruding upward (in a +Z direction) at an end as seen in a −Y direction in a region in abutment with the protective sheet 56. The slope 311 prevents the protective sheet 56 following the carriage 61 from contacting the carriage 61 during movement in the −Y direction. This suppresses changes in the posture and speed of the carriage 61.

Figure 8A:
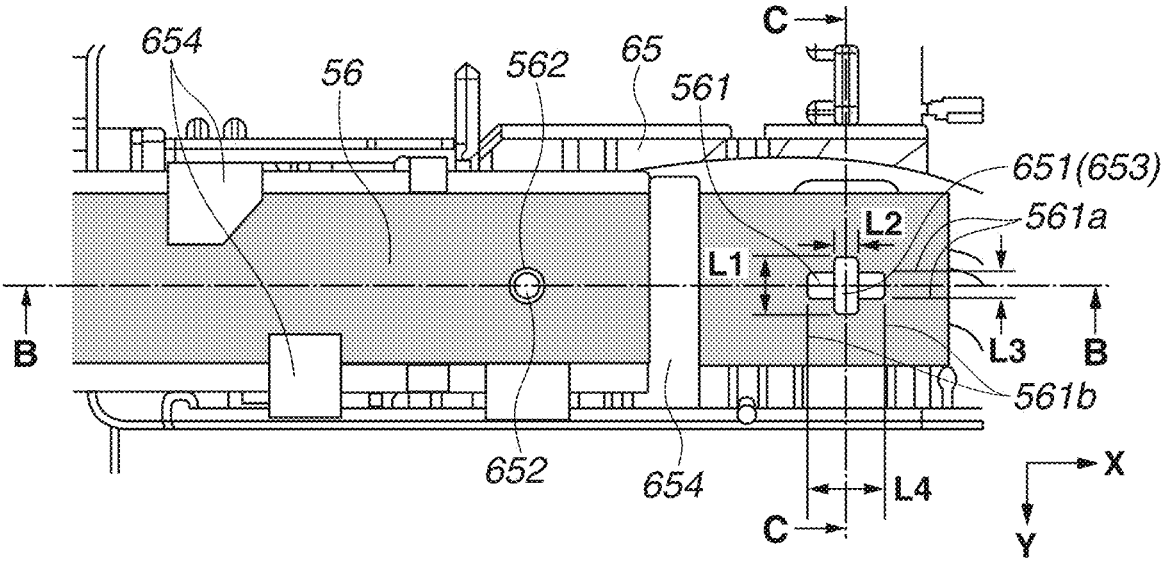
FIGS. 8A, 8B, and 8C are diagrams describing a fixing method of a protective sheet according to the present exemplary embodiment.
Figure 8B:
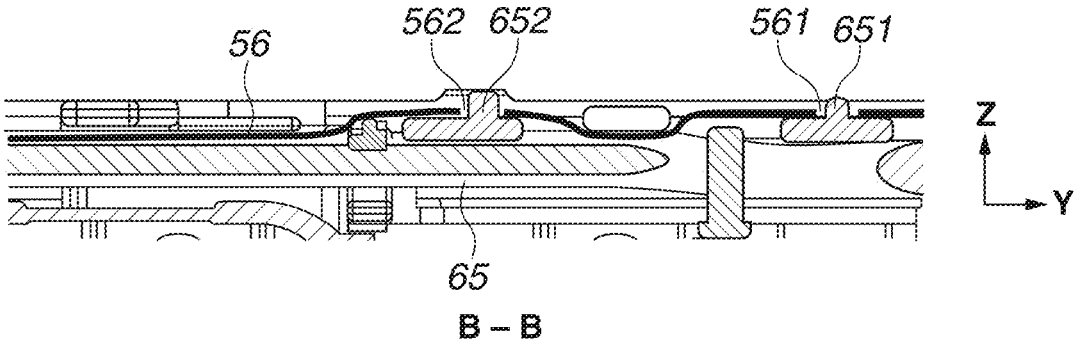
Figure 8C:
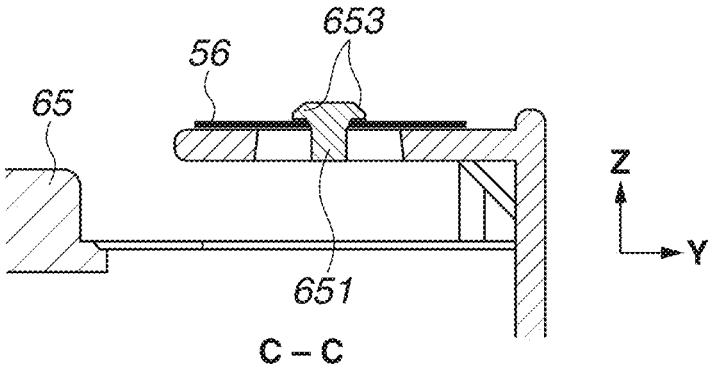

A fixing method of the protective sheet 56 will be described in detail with reference to FIGS. 8A to 8C. FIG. 8A is an enlarged top view of a part of the protective sheet 56 fixed to the holder 65, and FIG. 8B is a cross-sectional view taken along a line B-B in FIG. 8A. FIG. 8C is a cross-sectional view taken along a line C-C in FIG. 8A.

The protective sheet 56 has a first opening 561 and a second opening 562. The first opening 561 is formed of short sides 561*a* and long sides 561*b*, which are parallel to each other. In the present exemplary embodiment, the short sides 561*a* extend in the Y direction, and the long sides 561*b* extend in the X direction. In addition, the first opening 561 has a rectangular shape, but can have a long circular hole shape, for example, as far as the first opening 561 has the long sides 561*b*.

The second opening 562 has a circular hole shape and is smaller in opening area than the first opening 561. The second opening 562 does not necessarily have a true circle shape and can have a non-circular hole shape (for example, a square hole shape).

The holder 65 has a first projection 651 that protrudes upward (in the +Z direction) and is insertable into the first opening 561, and has a second projection 652 that protrudes upward (in the +Z direction) and is insertable into the second opening 562.

As illustrated in FIG. 8C, the first projection 651 has a hook portion 653 extending in the Y direction at an upper end thereof. In a state where the protective sheet 56 is attached to the holder 65, a length of the first projection 651 (including the hook portion 653) in the Y direction is designated as L1, a length of the same in the X direction is designated as L2, a length of the short sides 561*a* of the first opening 561 in the Y direction is designated as L3, and a length of the long sides 561*b* of the same in the X direction is designated as L4. These lengths are to satisfy the relationship $L2<L3<L1<L4$.

Due to the relationship $L3<L1$, in a state where the protective sheet 56 is attached to the holder 65, the hook portion 653 covers and overlaps the protective sheet 56 to suppress the protective sheet 56 from being pulled out upward. At the time of assembly, while the protective sheet 56 is rotated 90 degrees in an XY plane from the attachment state as illustrated in FIGS. 8A to 8C, the first projection 651 is inserted into the first opening 561, and then the protective sheet 56 is rotated 90 degrees in the opposite direction to return to the original position, whereby the protective sheet 56 is completely attached. That is, at the time of attachment of the protective sheet 56, the protective sheet 56 is rotated 90 degrees to bring the hook portion 653 and the long sides 561*b* of the first opening 561 into parallel with each other and then the first projection 651 is inserted into the first opening 561. At this time, due to the relationships $L2<L3$ and $L1<L4$, the first projection 651 is easily insertable into the first opening 561.

As described above, when the first projection 651 is inserted into the first opening 561, the short sides 561*a* of the first opening 561 and the first projection 651 come into engagement with each other. Further, when the second projection 652 is inserted into the second opening 562, the second projection 652 comes into engagement with the second opening 562 (see FIG. 8B). These engagements allow the protective sheet 56 to be unlikely to come off from the holder 65 in all the X, Y, and Z directions even if the protective sheet 56 is pulled by the user. In addition, there is no need to provide a separate member to cover the first projection 651 of the holder 65, which contributes to the decrease in parts count and the suppression of size increase of the apparatus.

In the above-described configuration, the first projection 651 is longer in the Y direction than in the X direction, and the first opening 561 is longer in the X direction than in the Y direction in the state where the protective sheet 56 is attached to the holder 65. However, the present disclosure is not limited to this. That is, if the first projection 651 is longer in the X direction than in the Y direction and the first opening 561 is longer in the Y direction than in the X direction in the state where the protective sheet 56 is attached to the holder 65, similar advantageous effects can be obtained.

Further, the holder 65 in the present exemplary embodiment has a plurality of projections 654, which extends in a short-side direction (Y direction) of the protective sheet 56 and is arranged in the X direction. The projections 654 cover the protective sheet 56 from above and serve as regulation units to regulate the movement of the protective sheet 56 in the Z direction and the Y direction. Providing the projections 654 regulates the movement of the protective sheet 56 in an upward direction (Z direction) and further suppresses the protective sheet 56 from coming off from the holder 65.

According to the above exemplary embodiment, it is possible to provide a liquid discharge apparatus that is capable of suppressing a protective member for a tube from coming off.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-020825, filed Feb. 12, 2021, which is hereby incorporated by reference herein in its entirety.

What is claimed is:

1. A liquid discharge apparatus comprising:

a liquid container configured to contain a liquid to be supplied to a liquid discharge unit configured to discharge the liquid;

a tube configured to connect the liquid discharge unit and the liquid container;

a holding unit configured to hold the liquid discharge unit;

a protective member disposed along the tube and configured to protect the tube; and a holder provided with the holding unit and configured to hold the protective member, wherein the holder holds the protective member by a first projection of the holder being inserted into a first opening provided in the protective member, such that a portion of the first projection protrudes from the first opening, and, in a state where the protective member is attached to the holder, a length of the portion of the first projection in a first direction in which a short side of the first opening extends is greater than a length of the first opening in the first direction, and the length of the portion of the first projection in the first direction is less than a length of the first opening, in a second direction, the second direction crossing to the first direction.

2. The liquid discharge apparatus according to claim 1, wherein, in the state where the protective member is attached to the holder, a length in the second direction of the portion of the first projection is less than the length of the first opening in the first direction.

3. The liquid discharge apparatus according to claim 1, wherein the first direction corresponds to a short-side direction of the protective member, and the second direction corresponds to a long-side direction of the protective member.

4. The liquid discharge apparatus according to claim 1, wherein the holder has a second projection configured to engage with a second opening provided with the protective member.

5. The liquid discharge apparatus according to claim 1, wherein the holder has a regulation unit configured to regulate movement of the protective member in a vertical direction.

6. The liquid discharge apparatus according to claim 5, wherein the regulation unit regulates movement of the protective member in the short-side direction.

7. The liquid discharge apparatus according to claim 1, wherein the holding unit is a carriage configured to reciprocate.

8. The liquid discharge apparatus according to claim 7, further comprising:

a cover member pivotally supported to be turnable with respect to the liquid discharge apparatus; and a clip configured to bundle the tube, wherein the clip keeps abutment with a lower surface of the cover member in a region where the carriage moves.

9. The liquid discharge apparatus according to claim 1, further comprising:

a conveyance unit configured to convey, in a conveyance direction, a recording medium on which the liquid is to be discharged by the liquid discharge unit; and a fixing member disposed downstream of the holding unit as seen in the conveyance direction and configured to fix the tube, wherein the fixing member has a slope extending upward at an end of an upstream side as seen in the conveyance direction.

10. The liquid discharge apparatus according to claim 1, wherein the protective member is a flexible sheet member.

11. The liquid discharge apparatus according to claim 1, wherein the liquid container is provided with an injection port for injecting the liquid into an inside of the liquid container.

12. The liquid discharge apparatus according to claim 1, wherein a long side of the first opening extends in the second direction.

* * * * *